United States Patent [19]

Postmus et al.

[11] Patent Number: 5,006,681

[45] Date of Patent: Apr. 9, 1991

[54] LEAF SPRING SYSTEM AND AN ELECTRIC SWITCH PROVIDED WITH SUCH A LEAF SPRING SYSTEM

[75] Inventors: Albert J. Postmus, Hengelo; Derk van der Scheer, Goor, both of Netherlands

[73] Assignee: Holec Systemen En Componenten B.V., Hengelo, Netherlands

[21] Appl. No.: 291,257

[22] Filed: Dec. 28, 1988

[30] Foreign Application Priority Data

Dec. 31, 1987 [NL] Netherlands ..... 8703173

[51] Int. Cl.[5] ..... H01H 5/14

[52] U.S. Cl. ..... 200/409; 200/408; 200/456; 200/445; 267/159

[58] Field of Search ..... 200/408, 409, 445, 452, 200/283, 454, 456, 459, 461; 74/100 P; 267/159, 163, 164, 160, 181, 47, 41

[56] References Cited

U.S. PATENT DOCUMENTS

| | | | |
|---|---|---|---|
| 2,695,524 | 11/1954 | Eaton | 200/408 |
| 2,697,364 | 12/1954 | Koch | 200/408 |
| 2,708,371 | 5/1955 | Pashby | 200/408 |
| 2,750,802 | 6/1956 | Pashby | 200/409 |
| 2,825,779 | 3/1958 | Kelleigh | 200/445 |
| 3,154,648 | 10/1964 | Shepherd et al. | 200/445 |
| 3,243,548 | 3/1966 | Kjellman et al. | 200/408 |
| 4,109,121 | 8/1978 | Bauer et al. | 200/456 |
| 4,559,422 | 12/1985 | Mironenko et al. | 200/454 |
| 4,751,351 | 6/1988 | Lambke | 200/409 |

FOREIGN PATENT DOCUMENTS

| | | | |
|---|---|---|---|
| 1189971 | 4/1970 | United Kingdom | 200/409 |

*Primary Examiner*—Henry J. Recla
*Assistant Examiner*—Glenn T. Barrett
*Attorney, Agent, or Firm*—Watson, Cole, Grindle & Watson

[57] ABSTRACT

A leaf spring system, in particular for influencing a least one body operating or comprising one or more contacts of an electric switch, with a frame aperature and at least one leaf spring which can act on the at least one body. The leaf spring system comprises a supporting frame for receiving the leaf spring in the frame aperture thereof. The spring is supported at one end and has another projecting free end whereby the one body to be influenced by the spring action is accommodated between this other end and the supporting frame. The dimension of the body in the frame aperture is greater than the distance between the edge of the supporting frame and the free end of the at least one leaf spring when the latter is situated essentially in the plane of the supporting frame. The supporting frame is secured against movement relative to the leaf spring and body. The invention further relates to electric switches provided with such a leaf spring system.

17 Claims, 8 Drawing Sheets

LEAF SPRING SYSTEM AND AN ELECTRIC SWITCH PROVIDED WITH SUCH A LEAF SPRING SYSTEM

BACKGROUND AND SUMMARY OF THE INVENTION

The invention relates to a leaf spring system, in particular for influencing at least one body operating or comprising one or more contacts of an electric switch, with a chassis and at least one leaf spring which can act on the at least one body. The invention also relates to leaf spring combinations to be used with and to electric switches provided with such a leaf spring system.

A leaf spring system of this type is for instance known from German Patent Specification DE-C-3,326,220.

In electric switches various switching functions are fully or partially dependent on a spring system. For example, spring systems are used, inter alia, for obtaining the force with which contacts are held against each other (contact force), in order to meet certain conditions under which the contacts have to open or close (threshold values), for achieving a desired switching speed etc. The choice of the spring system greatly affects both the working of the switch and the design thereof.

In most known spring systems helical tension or compression springs are used. These springs act with one end on the body to be influenced, for example a contact arm, while the other end is attached to the housing or the chassis of the switch. The forces exerted by these springs also act on the attachment of the spring to the housing or the chassis. In particular when relatively great forces have to be exerted, this attachment, and therewith the housing or the chassis, will have to be sturdy enough to absorb such great forces.

Moreover, a spring for achieving a particular function, for example for producing the contact force, often works badly, i.e. counterproductively, for producing another switching function such as, for example, the contact opening speed. In order to keep the effect of this poor working to a minimum, an additional requirement which is often set is that the working of the spring system must be degressive. This means that the influence of, for example, the contact force spring when another switch function comes into operation, for example the opening of the contacts, must decrease very rapidly and in some cases must even reverse its direction of operation. In order to make it possible to comply with such a requirement, the action point of the spring on the body to be influenced, the attachment point of the spring to the housing or the chassis and the rotation or hinge point of the body to be influenced are geared to each other in the overall construction in such a way that a decreasing couple or even one reversing in direction is produced. However, such a solution requires a relatively complex construction of springs and levers, such as for example that disclosed in European Patent Application EP-A-127,784.

A complex spring system is also necessary if a linear movement of, for example, a contact arm has to be carried out instead of a rotary movement. In order to obtain a degressive action, use will also have to be made here of lever systems and the like. With such complex constructions it is also so that if, in order to obtain as compact a construction as possible, one wishes to reduce the size of the moment arm of the body to be influenced by the spring action, the force to be produced by the spring will have to increase while the couple remains the same. The consequence of this again is that the spring itself will have to be stronger and thus larger, so that part of the envisaged space saving effect is wiped out. Furthermore, the action point and thus also the housing or the chassis will have to be designed for this greater force.

The leaf spring system disclosed in the above mentioned German Patent Specification 3,326,220 also has the disadvantage that the tension exerted on the housing or the chassis of the electric switch by the leaf spring acts on and causes wear in the hinge points of the leaf spring or of the body influenced by the leaf spring which are situated in the housing or the chassis. Since the housing or the chassis is generally made of plastic, these hinge points therefore require great attention and, particularly in the case of relatively great forces to be exerted by the leaf spring, must be of a special design and/or material composition.

The French Patent Specification 2,057,181 discloses also a leaf spring system for influencing the contact mechanism of an electric switch. The leaf spring can be brought in tensed position by means of a control knob and a connecting rod, said connecting rod being forced along a guide member. In tensed position, the leaf spring exerts a force on the contact mechanism as well as on the control knob, in particular their attachment or hinge points to the housing or chassis of the switch.

Of course, the housing or the chassis must be sufficiently sturdy to withstand the forces exerted on them by the leaf spring. For the abovementioned reasons, leaf spring systems of this type are seldom used in electric switches and only then if relatively small forces have to be exerted.

The object of the invention is therefore to produce a leaf spring system by means of which the abovementioned disadvantages of the known spring systems are eliminated, and in which the leaf spring system can also be simple and compact in design and can easily be adapted to the spring action required for a particular application, and comprises or needs a minimum of parts or aids.

This is achieved according to the invention in that the leaf spring system comprises a supporting frame for receiving in the frame aperture thereof, supported at one end, the at least one leaf spring, while in the frame aperture between the projecting free end of the leaf spring and the edge of the supporting framesituated opposite that end—the at least one body to be influenced by the spring action can be accommodated the dimensions of said body in the frame aperture being greater than the distance between the said edge of the supporting frame and the free end of the at least one leaf spring when the latter is situated essentially in the plane of the supporting frame, said supported frame being rigidly supported by the chassis.

In this context, with the term "rigidly supported" it is meant that said supporting frame is beared on the chassis, such that the supporting points for the at least one body to be influenced by the spring action and the at least one leaf spring of said supporting frame have a relative fixed position. For instance, this can be achieved by bearing the supporting frame on all sides or by using a suitable designed chassis for at least fixing the said supporting points. A supporting frame which is sufficiently rigid may be for instance mounted at the end sides thereof.

The leaf spring system according to the invention constitutes for virtually the most part a socalled closed force system, which means that the tension exerted by the leaf spring is largely absorbed by the combination of the leaf spring, the body and the supporting frame. This means that much lower strength requirements are needed for the housing or the chassis in which the leaf spring system according to the invention is mounted, compared to the known leaf spring systems, which results in a lower wall thickness and also a lower production accuracy, since no further requirements need be laid down for positioning and design of attachment points.

Even in switches in which relatively great forces have to be exerted by the leaf spring, the leaf spring system according to the invention can be mounted directly in a housing of, for example, plastic. The leaf spring system according to the invention is both simple in design and compact in construction, so that the dimensions of the switch in which such a leaf spring system is used can be smaller than corresponding switches with a spring construction provided with lever systems, coil springs and the like.

It is pointed out that U.S. Pat. No. 2,685,007 discloses a leaf spring system for use in an electric switch, comprising a frame, in the frame aperture of which a leaf spring and a body to be influenced by the leaf spring is accommodated. However, the frame actively takes part in the spring action of the leaf spring system. Such, in that the frame is movably positioned for acting as a bending spring, in order to achieve the specified switching function.

In contrast to the supporting frame according to the invention, the frame in this known leaf spring system is not rigidly supported by a chassis, such that only a force action transverse to the frame aperture can be effectively used, i.e. in the direction of movement of the frame. Because of the rigid support of the supporting frame according to the invention, the tension in longitudinal direction of the leaf spring can be used, for instance to achieve a specified contact force or switching speed. The tension in longitudinal direction of a leaf spring can be a multiple of the said force in transverse direction.

British Patent Specification 538,317 discloses also a leaf spring system with a frame, in the frame aperture of which a body is accommodated on which two leaf springs are acting. However, the frame is also movably supported to achieve the desired spring action. This embodiment differs further from the leaf spring system according to the invention, in that the body is not supported by an edge of the frame, but by the free ends of the opposite leaf springs. Even by rigidly supporting said frame according to the invention, it is not possible to use the bending force of the leaf springs, because putting one leaf spring under tension results in a deflection of the other leaf spring, as a consequence of which the position of the supporting point of the body of said other leaf spring is moved.

Further it is pointed out that German Patent Application DE-A-3409393 also discloses a spring system and an electric switch in which the force exerted by the spring is not transferred directly to the housing or the chassis of the switch either. However, this is not a leaf spring system, nor is it a leaf spring system which is integral with a supporting frame such as that in the invention. Besides, the force exerted by the spring does not lie in the plane of a frame as in the case of the invention. Deformation of the supporting frame is therefore quite possible here.

The supporting of the leaf spring by the supporting frame is achieved in an embodiment of the spring system according to the invention in such a way that the at least one leaf spring at the supported end thereof is integral with the supporting frame and extends from this end into the frame aperture.

Depending on the required spring force, the length of the leaf spring and its deflection relative to the frame aperture, such great bending stresses can occur on the transition between the leaf spring and the supporting frame that cracks occur or the spring material is stressed even to above its yield point, which in the end leads to rupture. Particularly in compact, relatively small switches with high contact force and/or switching speed, it is advantageous to use the leaf spring system according to a further embodiment of the invention, which is characterized in that the at least one leaf spring is detachably supported in the frame aperture.

According to yet another embodiment of the invention, this method of supporting is achieved in such a way that a supporting element for detachably supporting the at least one leaf spring is disposed in the frame aperture between the end of the at least one leaf spring to be supported and a further edge—situated opposite that end—of the supporting frame. The bending force acting in the supporting point on the leaf spring is now transferred to the supporting frame via the hingedly supported end thereof and the supporting element, so that the bending stresses occurring in the supporting point are greatly reduced compared with the embodiment in which the leaf spring is integral with the supporting frame. According to the invention, the supporting element can be a further body of an electric switch to be influenced by the spring action.

With the leaf spring system according to the invention it is fairly simple to obtain the required degressive action. For this, it is only necessary to make a suitable selection relative to each other of the points of action of the end of the leaf spring and the opposite edge of the supporting frame on the body to be influenced by the spring action. With a proper selection of the points of action and the shape of the body, it is possible to produce either a rotary or a linear movement thereof, so that the leaf spring system according to the invention can be used in various types of electric switches. The size and direction of the force exerted by the leaf spring on the body can also thus be determined.

An embodiment of the leaf spring system according to the invention provided with at least one body to be influenced by the at least one leaf spring, with which such degressive action is obtained that the spring action changes direction, is characterized in that the at least one body comprises an arm which projects from the frame aperture and can make a rotary movement about the opposite edge of the supporting frame, said arm being capable of producing such bending of the at least one leaf spring that when the arm is moved against the spring action past a transition point, the spring action thereon reverses direction and the at least one leaf spring can exert a force on the arm in this reversed direction of movement.

An embodiment of the leaf spring system according to the invention which is advantageous for practical applications in an electric switch is characterized in that the leaf spring system comprises two leaf springs which extend in line with each other from a common frame part for supporting the leaf springs, in such a way that the free ends of said leaf springs each point in an opposite direction, each free end of the respective leaf springs being able to act on an appropriate arm.

Such a construction with two arms can also be achieved advantageously in that the further body comprises a similar arm, the distance between the two bodies in the frame aperture being smaller than the length of the at least one leaf spring when the latter is situated essentially in the plane of the supporting frame. The leaf spring here is thus hingedly clamped in the frame aperture between the two arms. The two arms can project in the same direction or in opposite directions from the plane of the frame aperture.

Instead of rotary arms, movable contact blocks can, for example, also be incorporated in the frame aperture as a body. According to yet another embodiment of the leaf spring system according to the invention, this is achieved through the fact that the at least one body is hingedly connected to the free end of the at least one leaf spring and is movable in a direction at right angles to the opposite edge of the supporting frame.

Such a spring system can also be further constructed according to the invention in such a way that the at least one body under the influence of the at least one leaf spring can assume a first position in which the body is removed from the opposite edge of the supporting frame and a second position in which the body rests under spring force against the opposite edge of the supporting frame.

In order to reduce the mechanical stresses working in the supporting point of the leaf spring and/or in order to obtain an envisaged spring action, the leaf spring can be shaped as required, deviating from its rectangular basic shape. For a reduction of the mechanical stresses in the supporting point, the leaf spring can be widened out towards its end which is to be supported, being for example trapezoidal. The free end of the leaf spring acting on the body can be made in widened form in order to bring about good distribution of the forces in the action point with the body. The at least one leaf spring can to this end also consist of several spring strips connected to each other at one end.

A compact construction of an electric switch with a leaf spring system according to the invention, in addition to a minimum of parts, is also achieved in that the leaf spring may be loaded to its breaking limit, so that with this leaf spring great forces can be exerted, thereby making it possible to select a small moment arm, so that the construction of the switch can be compact in certain respects. Through the largely closed force construction of the spring system, the housing or the chassis by which the supporting frame is supported can still be kept light in construction.

The leaf spring and the supporting frame can be made of a strip of spring material by punching, stamping, spark erosion or etching.

The invention will now be explained with reference to a number of embodiments and the attached drawings.

DETAILED DESCRIPTION OF THE INVENTION

Figure 1:
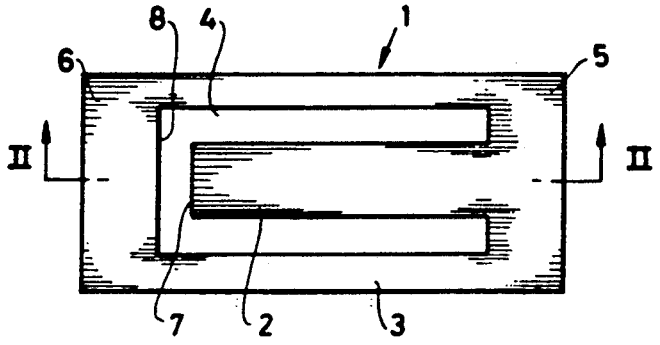
FIG. 1 shows a plan view of a leaf spring system according to the invention, comprising a leaf spring and supporting frame designed as one unit.

FIG. 1 shows schematically a leaf spring system 1 according to the invention, in which a single leaf spring 2 is fixed at one end to a supporting frame 3 completely enclosing the leaf spring 2. The leaf spring 2 extends into the frame aperture 4 from the frame side 5 to the opposite frame side 6, it being possible to dispose between the free end 7 of the leaf spring 2 and the inside edge 8 of the opposite frame side 6 a body to be influenced by the leaf spring. The leaf spring 2 and the supporting frame 3 are preferably made of the same resilient sheet material, and at rest, i.e. without body, the leaf spring 2 will lie in the plane of the supporting frame 3.

The chassis or base for the rigid support of the supporting frame is shown as 100. As already mentioned before, the supporting frame can be mounted to a separate chassis or also to the housing of a switch. This is also dependent on the shape, dimensions and the mechanical characteristics of the supporting frame and the switch in which it is to be used. However, it is important that the supporting points of the at least one spring leaf and the at least one body in operation maintain a relative fixed position.

Figure 2A:
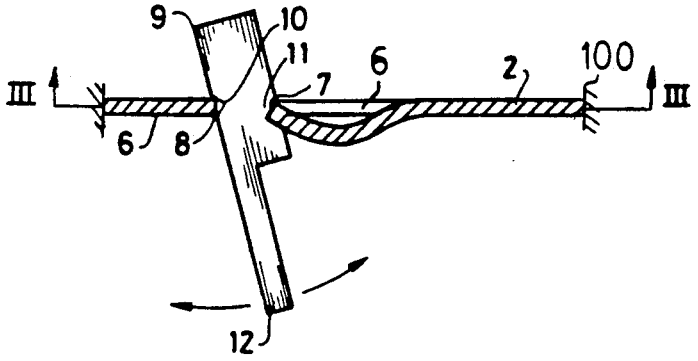
FIGS. 2*a–c* show a cross section along the line II—II of the spring system according to FIG. 1, with a rotary arm which is movable in the direction of the arrow, in various positions.

FIG. 2*a* shows a cross section through the line II—II of FIG. 1, in which a body to be influenced in the form of a rotary arm 9 is clamped between the edge 8 of the opposite frame side 6 and the free end 7 of the leaf spring 2. The rotary arm 9 can swing about the action point of the inside edge of the frame side 6 in the directions of the arrow. The clamped part of the rotary arm 9 has on either side two notches 10 and 11 in which the inside edge 8 and the free end 7 of the leaf spring 2 respectively engage. Since, as FIG. 2*a* indicates, the space between the free end 7 of the leaf spring 2 and the inside edge 8 of the supporting frame 3 is smaller than the dimension of the rotary arm in the frame aperture at right angles to the opposite frame side 6, the leaf spring 2 in the indicated position undergoes a double bending, during which the free end 7 of the leaf spring 2 will exert a force on the rotary arm 9 via the notch 11.

The way in which the spring action influences the movement of the rotary arm 9 is essentially determined by the position of the points of action of the supporting frame (support) and the leaf spring on the rotary arm 9, consequently the place of the notches 10 and 11 respectively. The degree to which the leaf spring 2 is bent has hardly any effect on the size of the force exerted by the leaf spring, so that the above-mentioned dimension of the rotary arm 9 in the frame aperture relative to the length of the leaf spring 2 will not be critical. The force exerted by the leaf spring on the rotary arm will therefore have a constant (high) value over a relatively large range of dimensions.

Figure 2B:
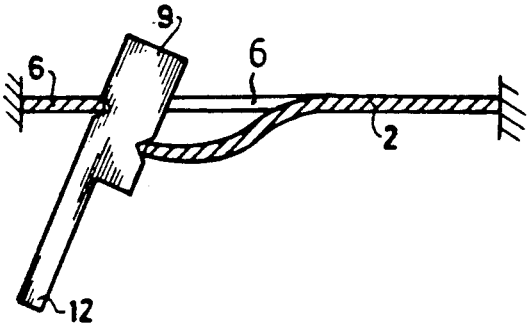
Figure 2C:
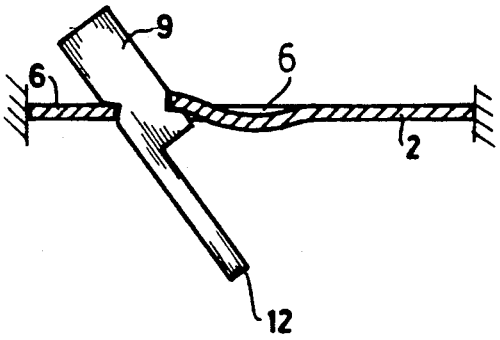
Figure 3:
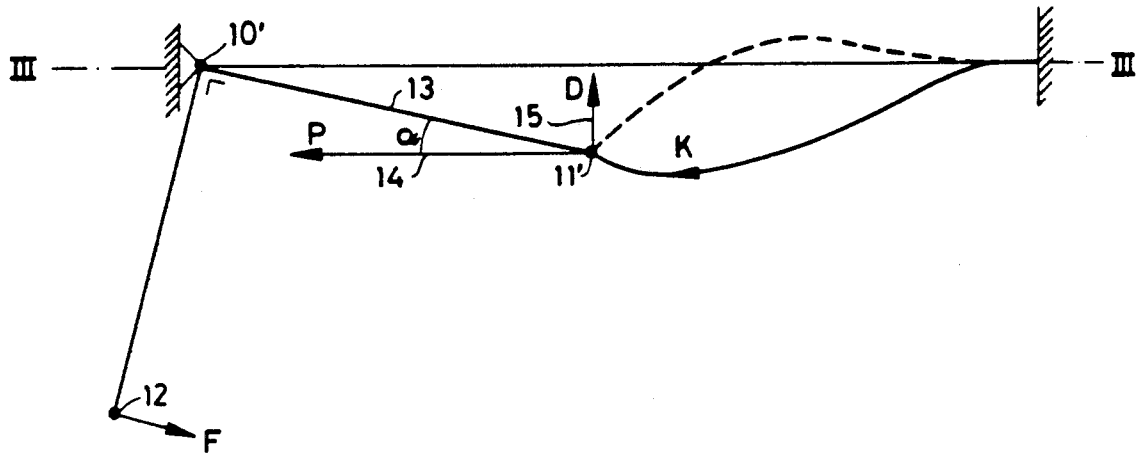
FIG. 3 shows (not to scale) part of the forces acting in a spring system according to FIG. 2.

FIG. 3 shows schematically (not to scale) the forces which can occur momentarily in, for example, a spring system according to FIG. 2. The point of support 10' corresponds to the position at which the supporting frame engages in the notch 10 of the rotary arm 9, while the action point 11' corresponds to the position at which the leaf spring 2 engages in the notch 11 of the rotary arm 9. The end 12 of the rotary arm 9 is represented by a point in the figure.

The force K exerted by the leaf spring on the rotary arm can be assumed resolved into a force P, represented by the vector 14, parallel to the line III—III in the plane of the supporting frame and a force D, represented by the vector 15, and perpendicular to P and to the above-mentioned plane.

The length r of the connecting line 13 corresponds to the size of the rotary arm measured between the notches 10, 11. The angle $\alpha$ between the connecting line 13 and the centre line III—III (FIG. 2*a*) of the supporting frame is determined by the current position of the rotary arm 9 relative to the centre line III—III. We now look at the moments of the forces relative to the point of support 10'.

The force P in the situation shown in FIG. 3 with a couple arm length r sin $\alpha$ delivers a couple which is clockwise (positive) relative to the point of support 10' viewed in the plane of the drawing. The couple arm length r sin $\alpha$ is the distance measured at right angles to the plane of the frame from the line III—III to the action point 11'. The force D supplies in the direction shown in FIG. 3 with a couple arm length r cos $\alpha$ a anti-clockwise (negative) couple relative to the point of support 10'. The arm length r cos $\alpha$ is the distance measured parallel to the line III-III between the point of support 10' and the action point 11'. According to the vector diagram of FIG. 3, a resulting couple acts on the rotary arm to make the rotary arm perform a clockwise movement about the point of support 10', viewed in the plane of the drawing, and to take the rotary arm into a first position of rest. Until this first position of rest is achieved a force F will be present at the end 12 of the rotary arm, by means of which a certain switch function can be carried out. When the rotary arm is not being limited in movement, it will take up its first rest position, at which the leaf spring is slightly bent, as shown in FIG. 2*b*. The resulting force F acting on the end 12 of the rotary arm is equal to zero here.

When the rotary arm is subsequently moved from this first rest position anticlockwise relative to the point of support 10' against the spring force, the leaf spring will be further bent (tensioned), and a situation arises in which the couples exerted by the forces P and D and their respective moment arms r sin $\alpha$, r cos $\alpha$ just cancel each other out, with the result that the leaf spring exerts no resulting force on the end 12 of the rotary arm. This is the so-called "dead" position or the transition point. When the rotary arm is moved past this transition point, the leaf spring will exert a force acting in the direction of movement on the rotary arm and will move the latter to a second rest position in which the leaf spring is bent as shown in FIG. 2*c*.

In the situation where the leaf spring acts on the rotary arm according to the situation indicated by the dotted lines in FIG. 3, the force K can also be considered resolved into the respective forces D and P.

Figure 4A:
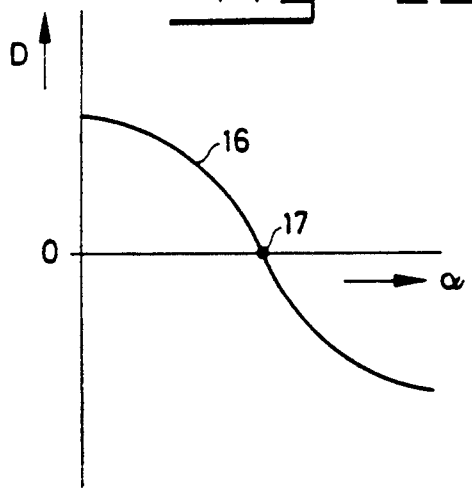
FIG. 4*a* shows in graph form, not to scale, the curve of a component of the force acting by the leaf spring on the rotary arm of FIG. 2 as a function of the deflection of the rotary arm relative to the plane of the supporting frame.

Within the range of application of the spring system it may be assumed that the force P is constant. The development of the force D in relation to the angle $\alpha$ is illustrated in graph form, not to scale, by the curve 16 in FIG. 4*a*. From a maximum value, in which the angle $\alpha$ is equal to zero, the force D decreases until at the transition point 17 its value has fallen to zero. Past this transition point D increases again, but its direction reverses relative to the situation shown in FIG. 3.

Figure 4B:
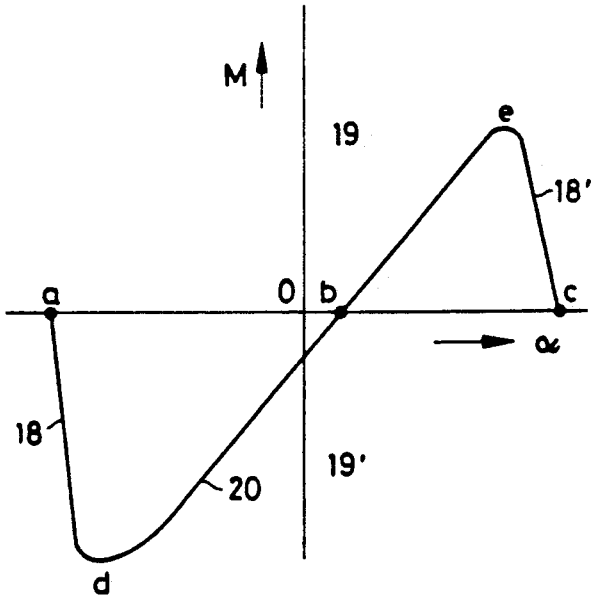
FIG. 4*b* shows in graph form, not to scale, the curve of the moment acting on the free end of the rotary arm of FIG. 2 as a function of the deflection of the rotary arm relative to the plane of the supporting frame.

The development of the moment M exerted on the rotary arm by the leaf spring as a function of the angle $\alpha$ is illustrated in a graph, not to scale, in FIG. 4*b*. In this graph the parts 18, 18' are largely determined by the characteristics of the leaf spring, namely in the sense that a slight bend already generates a great force. A small turn in the rotary arm will thus produce a rapid increase in force on the rotary arm. The part 20 of the graph is largely determined by the current couple arms because in the field of application the force may be assumed to be constant.

A moment corresponding to a clockwise movement is shown in the top half face 19, while a moment corresponding to an anticlockwise movement is shown in the bottom half face 19'. In the rest positions a and c the resulting moment acting on the rotary arm is equal to zero, as in the transition point b. The extremes d and e in the graph of FIG. 4 correspond to the positions in which the leaf spring deflects going from the two extreme rest positions a or c to the transition point b. The shape and position of the curve depends on a number of factors which can be influenced, such as the relative positions of the support point 10' and the action point 11' (or the notches 10, 11) of the rotary arm and the dimensioning and material characteristics of the leaf spring itself. It will thereby be clear that the envisaged degressive action of the leaf spring system as a whole can be geared to the relevant application.

FIG. 5 illustrates schematically a number of further embodiments of leaf spring combinations according to the invention. FIG. 5*a* shows in perspective a supporting frame 21 having two rectangular leaf springs 22 extending into the frame aperture in opposite directions, and being integral therewith. FIG. 5*b* shows in perspective a combination of two spring systems according to FIG. 1 which are integral with the supporting frame 23, and in which the leaf springs 24, 25 also have differing dimensions.

Figure 5A:
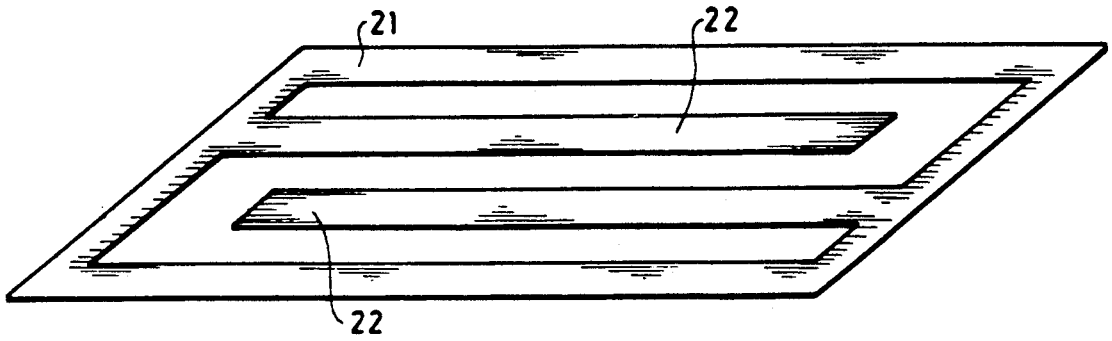
FIGS. 5*a–d* shows schematically a number of embodiments of leaf spring systems according to the invention in which the supporting frame and the leaf springs form one integral unit.
Figure 5B:
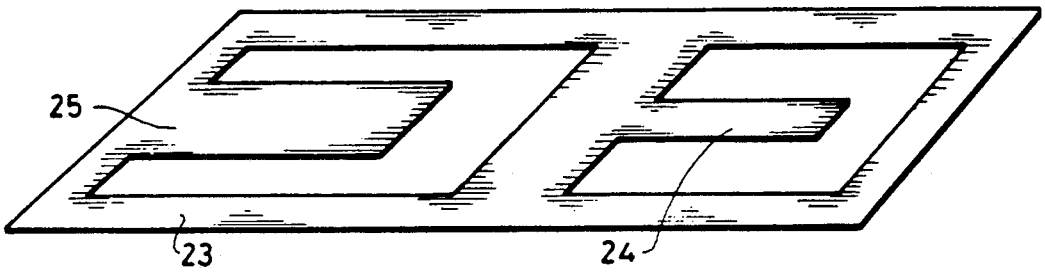
Figure 5C:
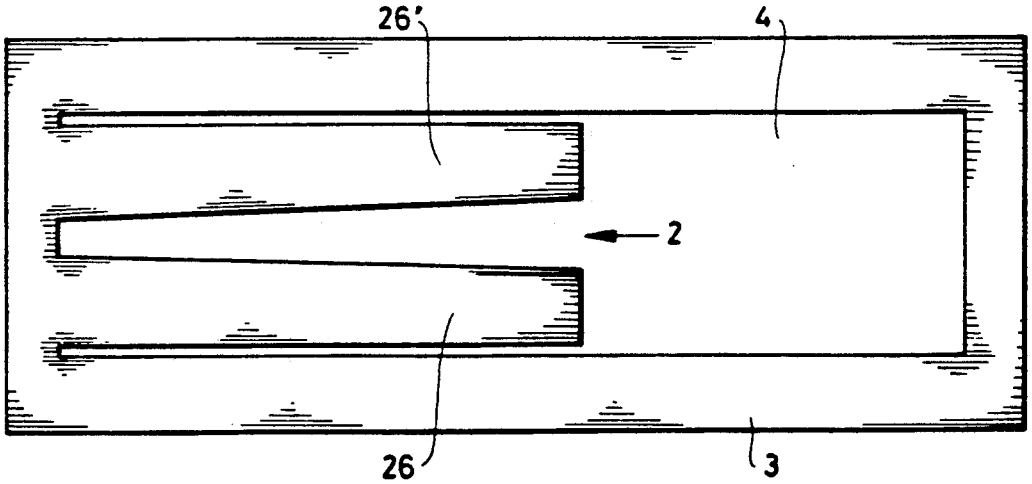

FIG. 5*c* shows the top view of a further embodiment of the leaf spring combination according to FIG. 1, where in order to influence the spring action, the leaf spring 2 narrows trapezoidally from the connection point to the supporting frame 3 towards the end. The mechanical tension in the spring can therewith be reduced at the connection point, while the spring characteristic can also be adjusted as desired. It will be clear that other forms are also possible to adapt the spring characteristic in the optimum fashion to requirements.

It can also be seen from FIG. 5*c* that the leaf spring 2 in fact comprises two parallel parts 26, 26'. This means that through different bending of the parallel parts, the spring can also move slightly laterally relative to the frame aperture 4, which can be necessary, for example, for use in an electric switch, in order for example in the event of uneven contact wear to be able to handle an out-of-true movable contact connected to the leaf spring, in which the contact pressure is held at virtually the same value over the entire width of the spring.

Instead of two parts, it is also conceivable to have a leaf spring consisting of several parallel parts or strips, and said parallel strips, as pointed out, can be rectangular, trapezoidal or of another shape, depending on the application. If one spring strip is now made unequal in length to the other spring strip(s), the leaf spring can be pretensioned in such a way that it has one or more deflecting preferred positions relative to the frame aperture. A leaf spring constructed in such a manner can then be advantageously used in situations in which the spring has to move back automatically from a particular locked position to its preferred position.

Figure 5D:
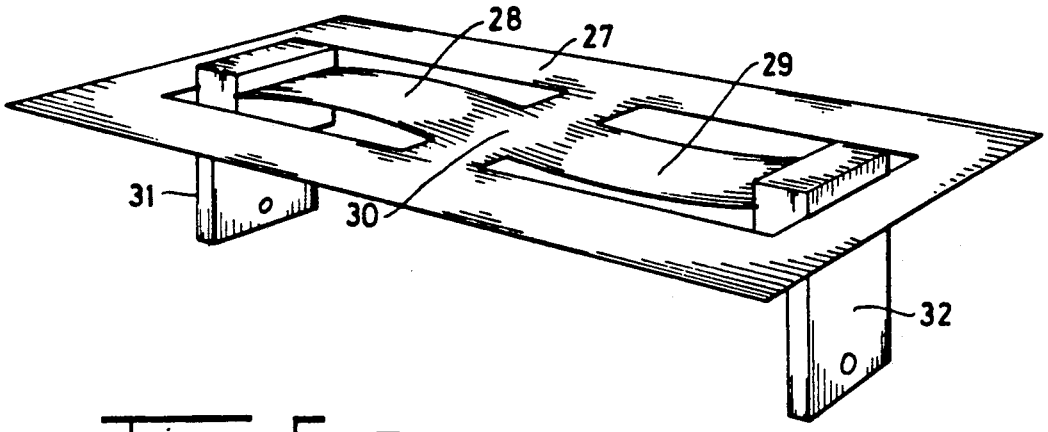

FIG. 5*d* shows a preferred embodiment having a supporting frame 27 with two leaf springs 28, 29 extending in line with each other from a common frame side 30, so that the free ends of said leaf springs each point in opposite directions and each act on a rotary arm 31 and 32 respectively, clamped between the free end of the leaf spring and the opposite frame side. This preferred embodiment can be used in a switch of the type discussed below with reference to FIGS. 7 and 9.

It goes without saying that it is possible to have several of the embodiments shown in FIG. 5, with an integral combination of supporting frames with leaf springs according to the invention, in which one or more frame sides are common.

As already pointed out in the introduction, in relatively short leaf springs, for example in very compact switch constructions, and/or with relatively great spring forces, for example such as those required in switches which have to be able to resist or switch off high short circuit currents through the switching contacts, such high mechanical stresses occur on the transition between the leaf spring and the supporting frame that a fixed connection of leaf spring and supporting frame is undesirable from a practical point of view, due to the high risk of cracks and fatigue in the spring material. The spring force is in such cases also difficult to predict.

Figure 6A:
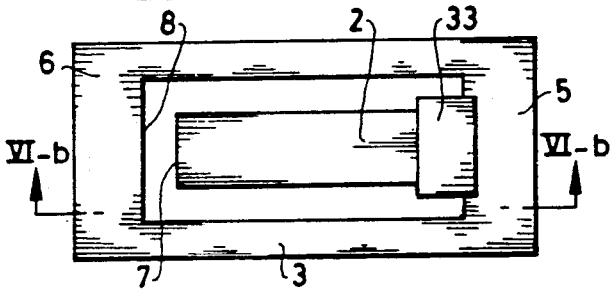
FIGS. 6*a–c* shows schematically a number of embodiments of leaf spring systems according to the invention in which the leaf spring is supported via a supporting element by the supporting frame.
Figure 6B:
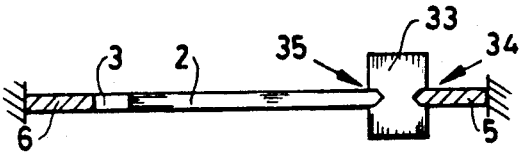
Figure 6C:
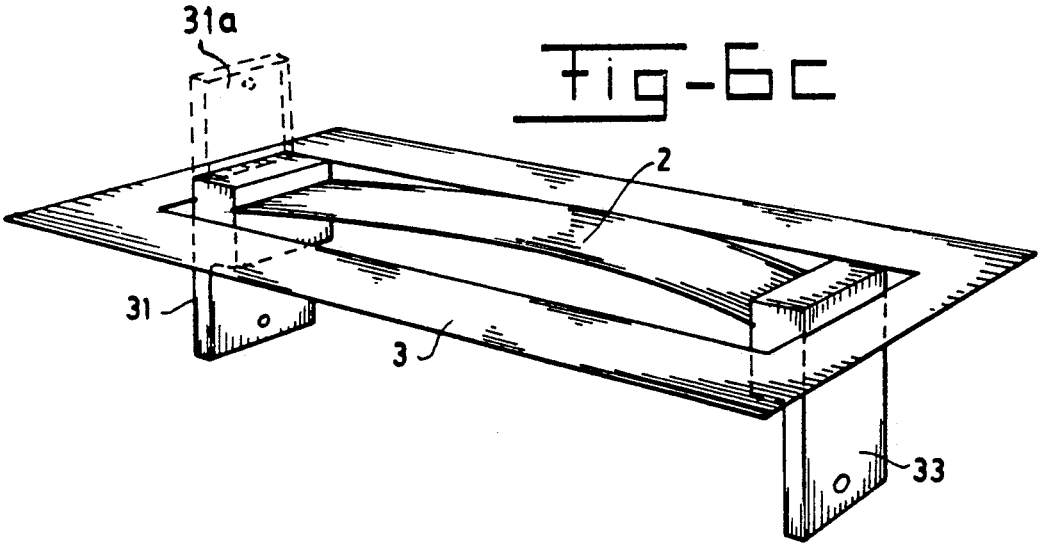

FIGS. 6*a–c* show, without a chassis, a number of embodiments of leaf spring systems according to the invention in which the leaf spring is detachably supported in the frame aperture of the supporting frame. The leaf spring system shown in plan view in FIG. 6*a* corresponds largely to the leaf spring system according to FIG. 1, parts with a corresponding function being indicated by the same reference numbers. The single leaf spring 2 is supported via a supporting element 33 by the frame side 5 of supporting frame 3. A body to be influenced by the leaf spring can be provided between the free end 7 of the leaf spring 2 and the inside edge 8 of the opposite frame 6 in a similar manner to that illustrated, illustrated, for example, in FIG. 2.

FIG. 6*b* shows a cross section through the line VI-b-VI-b of FIG. 6*a*. The supporting element 33 has on two opposite sides notches 34, 35, into which engage respectively the frame side 5 and the end of the leaf spring 2 to be supported. As a result of the hinged transition obtained between the leaf spring 2 and the supporting frame 3 by means of the supporting element 33, this spring system can be designed for greater forces than the spring system 1 in FIG. 1.

It goes without saying that the supporting element 33, shown as a rectangular block, can also be cylindrical, H-shaped or of other suitable geometrical shapes, or can be made up of several part elements. It is also possible for the supporting element to be fixed to, for example, the leaf spring 2 or the frame side 5, of course in such a way that the leaf spring 2 can hinge on the transition with the supporting frame 3.

FIG. 6*c* shows in perspective an embodiment of a leaf spring system with a rotary arm 31, in which the supporting element 33 is also designed as a rotary arm, so that a similar spring system to that shown in FIG. 5*d* is obtained. Through the absence of a fixed connection of the leaf spring to the supporting frame 3, this design is very suitable for those applications in which relatively great contact and/or switching forces are required. As designated by the dot-dash marks, the arm 31*a* can alternatively project in an opposite direction from the other arm 33.

The spring systems in which the leaf spring is detachably supported by the supporting frame can also be produced in many embodiments in accordance with the spring systems shown in FIG. 5, depending on the specific application thereof. Combinations of detachably supported and fixed leaf springs according to the invention which are integral with the supporting frame are also possible.

Figure 7:
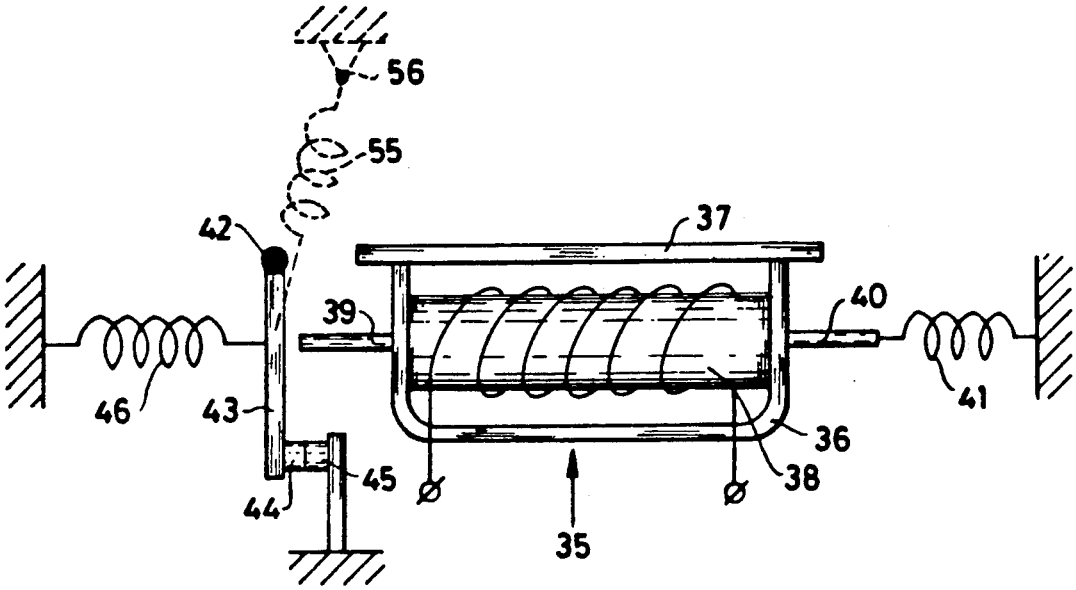
Fig-7 (PRIOR ART)
FIG. 7 shows schematically a possible embodiment of an electromagnetically operated switch with a spring system made up of coil springs, having therein a further embodiment thereof shown by dotted lines.

As already indicated in the introduction, the spring system according to the invention, as shown for example in FIG. 5*d*, can be advantageously used in electric switches. In order to illustrate this, FIG. 7 shows schematically a possible embodiment of a spring system made up of coil springs for an electromagnetically operated switch. Such a switch is used in those cases where the switch is to be operated automatically rather than manually, for example in an electrical energy distribution plant. The switch must then be capable of opening contacts automatically in certain conditions, for example in the event of a short circuit current, and for example must be able to close them again automatically when these conditions no longer prevail, thus when the short circuit current has disappeared.

The switch has for this purpose a magnet system 35, comprising a stator 36, a stator plate 37, an exciter winding 38, and an armature (not shown) moving in said exciter winding and having pin-shaped ends 39, 40 respectively. The pin-shaped end 40 is connected via a tension spring 41 to the housing or the chassis in which the switch is mounted. The pin-shaped end 39 can act on one contact arm 43 which is positioned at a distance away from it and moves about a point of rotation 42. Disposed at the free end of the contact 43 is an electrical contact 44, having opposite it a fixed contact 45. The movable contact arm 43 in the position shown is pressed by means of a compression spring 46 with its contact 44 against the fixed contact 45. The compression spring 46 forms the so-called contact force spring which has to ensure that the required contact force is exerted, while the tension spring 41 forms the so-called threshold spring, by means of which the threshold value of the current flowing through the exciter winding 38 is fixed, and above which the movable contact is operated. Both the contact force spring 46 and the threshold spring 41 are here constantly opposed to the direction of movement of the armature of the magnet system 35, so that the switching speed is adversely affected.

Figure 8:
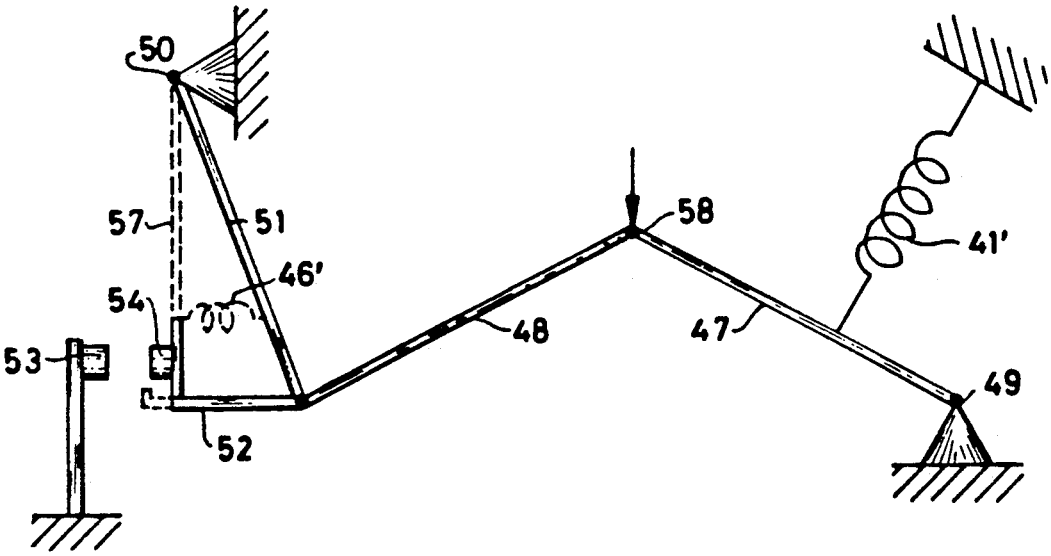
Fig-8 (PRIOR ART)
FIG. 8 shows schematically a possible embodiment of a spring system for a manually operated switch, made up of coils springs and levers, having therein a further embodiment thereof shown by dotted lines.

FIG. 8 shows schematically a possible construction of a spring system made up of coil springs and levers for a manually operated electric switch. A tension spring 41' fastened by one end to the housing or the chassis of the switch is connected by the other end to a lever 47 which can move at one end about a fixed hinge point 49 and is hingedly connected by its other end to an end of another lever 48 which with its other end engages hingedly on a movable contact arm 52, which is supported via a lever 51 movable about a fixed hinge point 50. A contact 53 is fixed opposite the contact 54 of the movable contact arm 52. The levers 47 and 48 form a so-called angle lever, in which by exerting a force—against the action of the tension spring 41' acting as a threshold spring—on the hinge point 58 of the two levers 47, 48, the movable contact 54 can be pressed against the fixed contact 53. The lever system 47, 48 can be pressed even further in the direction of the arrow (FIG. 8) after the contacts have come into contact with each other, causing the required contact force to be built up.

Such a switch is used, for example, in those cases where there is switching on by hand and switching off is permissible only under certain conditions, for example automatically. The magnet system serving for this automatic switching-off can be made very simple and light here and need only produce an unlocking. Such switches can be used, inter alia, in combination with a switch according to FIG. 7 in electrical distribution plants.

The spring systems shown for both the electromagnetically operated switch according to FIG. 7 and the manually operated switch according to FIG. 8 have a number of disadvantages. In order to eliminate to some extent the opposed action of the contact force spring 46, on the one hand, and the threshold spring 41, on the other—mentioned above concerning the electromagnetically operated switch shown in FIG. 7—on the armature of the magnet system 35, various solutions can be considered with the object of producing a degressive spring action. These solutions all essentially amount to reducing the moment arm of the couple exerted by the contact force spring 46 on the movable contact arm 43.

A possible solution is shown by dotted lines in FIG. 7. Instead of the compression spring 46 for generation of the contact force, use is now made of a tension spring 55 which acts at one end on the contact arm 43 and at the other end is fixed to an attachment point 56 which, viewed in the plane of the drawing, is higher than the hinge point 42 of the movable contact arm 43. The action point of said tension spring 55 on the movable contact arm 43, on the one hand, and the site of the attachment point 56 of the tension spring 55, on the other, are selected in such a way that the couple arm becomes smaller once the contacts 44, 45 are opened. Past a certain point, the couple exerted by the tension spring 55 can even reverse and help to open the contact.

For the spring system shown in FIG. 8 a similar improvement can also be indicated, and is also shown therein by dotted lines. The movable contact 54 here is situated on a further contact arm 57 fixed to the hinge point 50, provision being made for a compression spring 46' which acts on the contact arm 57 and the lever 51. The contact arm 52 here is therefore no longer connected to the further contact arm 57, but has a bend projecting beyond this further contact arm 57, as shown by a dotted line. This bend acts on the further contact arm 57 when the contacts 53, 54 open.

The contact pressure is now produced by the compression spring 46' acting as a contact force spring. Said contact force spring 46' is compressed when the contacts 53 and 54 touch each other, through the hinge point 58 of the lever system 47, 48 being pressed further in the direction of the arrow, as a result of which the required contact pressure is built up. When the locking of the lever system 47, 48 is released the energy stored in this contact force spring 46' will also contribute to the speed at which the contacts open.

Figure 9:
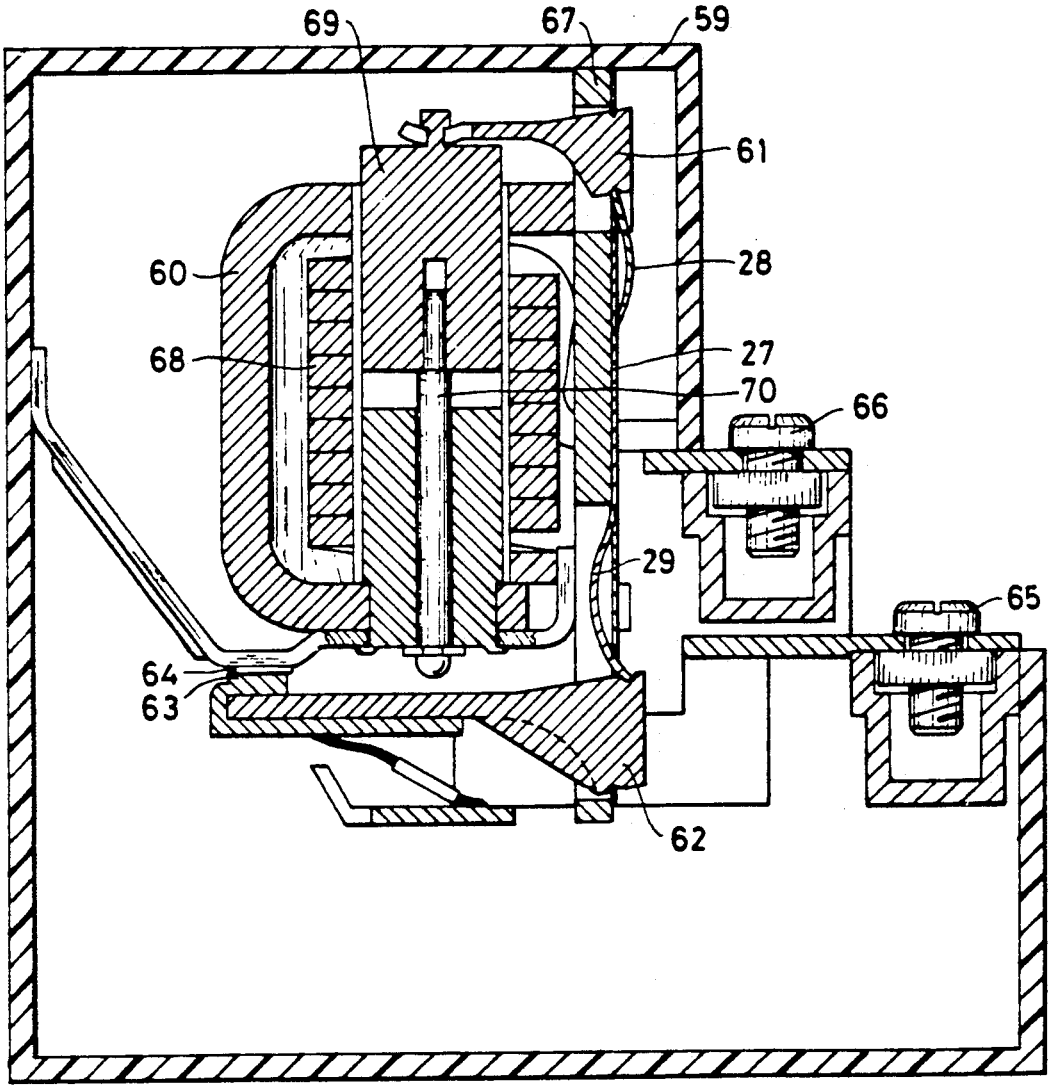
FIG. 9 shows by way of illustration in cross section an embodiment of an electromagnetically operated switch in which a spring system according to FIG. 5*d* is used, said switch constituting the subject of U.S. Pat. No. 4,935,711, issued June 9, 1990.

FIG. 9 shows by way of illustration an embodiment in cross section of an electromagnetic switch with a magnet system essentially like that in FIG. 7, but with a leaf spring system according to FIG. 5*d*. This switch forms the object of U.S. patent application 291,255, which was filed by applicant simultaneously with the present patent application.

The switch shown in FIG. 9 can be essentially divided into a housing 59, a magnet system 60, the contacts 63, 64, with their respective terminals 65, 66 and the spring system with the supporting frame 27, the leaf springs 28, 29 and rotary arms 61, 62 corresponding to the embodiment of the invention shown in FIG. 5*d*.

The magnet 60 comprises an exciter winding 68, a stator plate 67 and an armature 69 with an armature pin 70. The spring system is mounted on the stator plate 67, which forms the chassis for the rigid support of the supporting frame 27. The current by means of which the armature 69 will be attracted and will want to move in the direction of the rotary arm 62 runs through the exciter winding 68 of the magnet system 60. The armature 69 is, however, in this case retained by the rotary arm 61 coupled to the armature, because said rotary arm 61 is subject to a force of the leaf spring 28 opposite to the direction of movement. Depending on the influence on the rotary arm 61 by the leaf spring 28, when the current exceeds a certain value, for example in the event of a short circuit, the force of the spring action of the leaf spring 28 will be overcome by the magnetic force on the armature 69, as a result of which the armature moves in the direction of the rotary arm 62. Since the armature pin 70 then knocks against the rotary arm 62, said rotary arm 62 will be moved against the spring action of the leaf spring 29. Since the rotary arm 62 is connected to the moving contact 63 of the switch, the switch will be opened.

If it is now ensured that the angular displacement of the rotary arms 61 and 62 is such that the sum of the couples exerted by the respective leaf springs 28 and 29 does not change direction, said rotary arms will automatically return to their original position, i.e. the closed position of the switch shown in FIG. 9, once the magnetic force on the armature 69 falls below a certain value. Since the counter couple exerted by the leaf springs will decrease very rapidly with a slight displacement of the armature 69, the contacts of the switch will open more quickly when the threshold set with the rotary arm 61 is exceeded than in the case of a switch constructed according to FIG. 7.

On account of this and the (also rapid) automatic return to the closed position once the current falls below the set threshold value again, a switch with high contact speed is obtained. The leaf spring system is particularly simple and compact in construction, while both the threshold value produced by the rotary arm 61 and the contact force produced by the rotary arm 62 can be determined simply through the correct choice of the support and the action point of the respective leaf springs. The leaf spring system according to the invention also has the advantage that with one and the same leaf spring construction switches with varying threshold values and contact forces can be produced by fitting other rotary arms whose support and the action point of the leaf spring are positioned differently.

As can be seen from FIG. 9, and as is also explained in the above-mentioned Netherlands patent application 8703170, the leaf spring system according to the invention can be fitted simply on the magnet system and it can be placed as one unit in the housing 59 of the switch, without the springs having to be fastened separately to the housing 59, so that the latter can be kept relatively light in construction.

Figure 10:
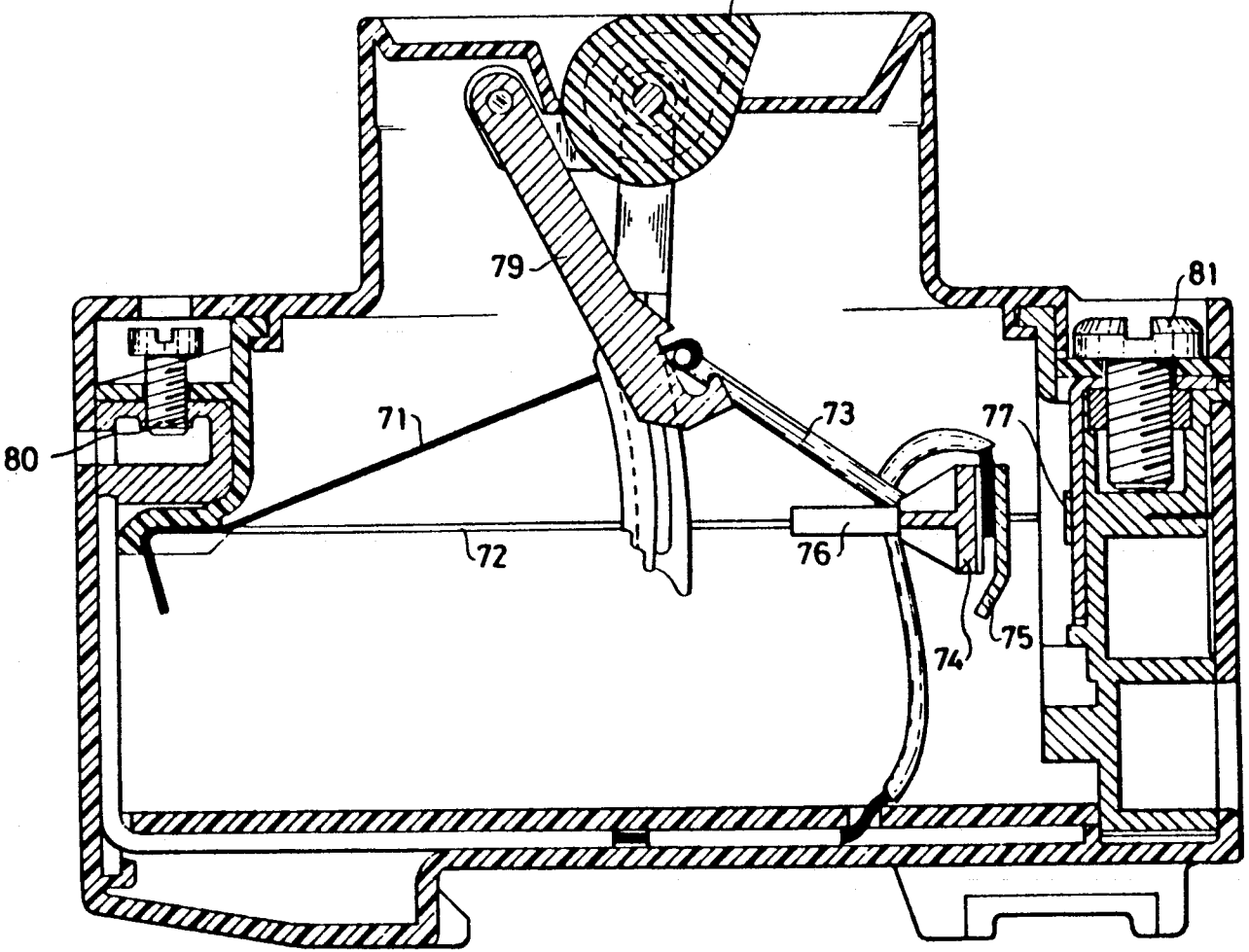
FIG. 10 shows by way of illustration an embodiment of a manually operated electric switch with a leaf spring system, said switch constituting the subject of the Netherlands patent application 8703172 entitled "Switch, in particular for use as automatic switch", which was filed by applicant simultaneously with the present patent application.

FIG. 10 shows by way of illustration an embodiment of a manually operated switch according to FIG. 8 in which a leaf spring system according to the invention as shown, for example, in FIG. 5*c* is used. This switch forms the subject of the abovementioned U.S. patent application 291,255, which was filed by applicant simultaneously with the present patent application. When such a switch is not designed for switching off an unlimited short circuit current, but where this short circuit current does fully flow through the con tacts thereof until the moment at which it is limited and/or switched off, the contacts of this (sequence) switch must be able to carry this short circuit current for a particular (short) period. This requires a high contact force, and this requirement can be met simply by using a leaf spring system according to the invention.

In FIG. 10 the leaf spring system comprising the leaf spring 71 and the supporting frame 72 can be seen. A wire bracket 73 is hingedly fastened at the free end of the leaf spring 71, on the other end of which a contact block 74 is hingedly fastened. The contact block 74 here carries the movable contact 75 of the switch and is slidably mounted by means of glider 76 in the frame aperture of the supporting frame 72 and connected to terminal 80. The fixed contact 77 is disposed at the frame side opposite the free end of the leaf spring 71 in the frame aperture of the supporting frame and is connected to the terminal 81. The housing of the switch forms the chassis for the rigid support of the supporting frame 72.

If now, with the aid of the manually operated button 78 and the arm 79 attached thereto, the leaf spring 71, which is bent upwards and is in the non-live state, together with the wire bracket 73 is moved in the direction of the supporting frame 72, the contact block 74 will be moved in the direction of the fixed contact 77, until both contacts 75, 77 come into contact with each other. If the leaf spring 71 is now forced even further towards the supporting frame 72, said leaf spring 71 will be bent further and will thereby exert an additional force on the closed contacts. As has already been mentioned, a slight bend of the leaf spring 71 will already result in a great contact force, which makes this construction extremely suitable for the above-mentioned application.

The construction shown, in which the leaf spring 71 acts on the movable contact via the wire bracket 73 acting as a lever provides a number of advantages over a construction in which the leaf spring 71 acts directly on the movable contact block 74. The contact block 74 can be kept small in dimensions in the embodiment shown, which benefits the compactness. Besides, with a relatively small vertical force from the manually operated button 78 it is possible to exert a relatively great horizontally acting force on the movable contact block 74, which is particularly important in the above-mentioned application of the switch for keeping it closed under short circuit conditions.

The manually operated switch 78 can be locked in the closed position of the switch, and the locking can be automatically released only under predetermined conditions. Of course, the switch can also be switched off at any time using the manually operated button 78. For further details concerning the action of this switch you are referred to the above-mentioned Netherlands patent application 8703172.

Figure 11:
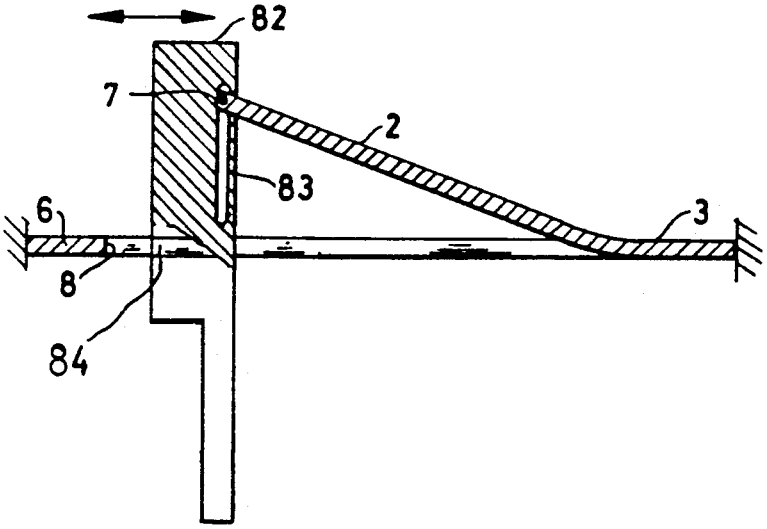
FIG. 11 shows in cross section an embodiment of a leaf spring system according to the invention with an arm which is hingedly connected to the leaf spring, and which can make a linear movement in the direction of the arrow.

FIG. 11 shows another embodiment of a spring system according to FIG. 2, in which the arm 82 makes a linear movement instead of a rotary movement and the leaf spring also fulfills two spring functions. Those parts which fulfill a similar function to that of FIG. 2 are indicated by the same reference numbers. In the position shown, the leaf spring 2 forms a certain angle with the supporting frame 3. The free end 7 of the leaf spring 2 is hingedly connected to the arm 82 and holds the arm in this position. If now the leaf spring 2 is moved in the direction of the supporting frame 3, the arm 82 will move in the direction of frame edge 8 because the end 7 of the leaf spring is moved in a groove-type guide 83 in the arm 82. With the aid of side grooves 84 in the arm 82 which mate with the insides of the supporting frame 3, it can be ensured that the movement of the arm 82 is rectilinear in the direction of the frame edge 8 until it rests against it. Through correct dimensioning, the leaf spring 2 in this position will not yet lie completely in the plane of the supporting frame 3 and, through pressing the leaf spring 2 further towards the supporting frame, it is possible to exert a certain force on the frame edge 8. If the force which has held the leaf spring 2 pressed towards the supporting frame 3 is now released, the arm 82 will return under the effect of the spring action to the position shown. With one leaf spring, one has thus obtained a twofold action, namely contact force and opening force.

The leaf spring with the attachment frame according to the invention can be produced simply from flat spring strip stock. For this, production methods which ensure good reproduction of the spring characteristics, such as, for example, stamping, punching, etching, laser radiation or spark erosion, can be used.

The leaf spring system according to the invention is, of course, not limited to the embodiments thereof shown and described, or to use in the embodiments of switches shown and described, but can also be advantageously used in other embodiments of electric switches, which can thereby be designed in a very simple manner to enable them to meet very specific requirements. Nor is the use of the leaf spring system according to the invention limited to electric switches, but it can also if necessary be advantageously used in those fields in which, using high spring forces, only a small force action may be exerted on the housing in which the leaf spring system is mounted.

We claim:

1. A leaf spring system for operation on at least one body, the leaf spring system used in combination with an immovable base member and comprising at least one leaf spring having first and second opposite ends, and a supporting frame defining at least one frame aperture having fixed first and second opposite edges, the leaf spring being supported at the first end thereof at said first fixed edge of the frame aperture, the second end of the leaf spring projecting in the direction of and terminating at a distance from said second fixed edge of the frame aperture, thereby defining a space for accommodating the body to be hingedly supported by said second fixed edge of the frame aperture and to be engaged by the second end of the leaf spring, the body having a dimension measured upon accommodation between the supporting second fixed edge of the frame aperture and the engaging second end of the leaf spring which is greater than the distance from the second fixed edge of the frame aperture to the second end of the leaf spring when the body is not accommodated in the space, the supporting frame being immovably fixed to the immovable base member and thereby secured against movement relative to the leaf spring and body during operation of the leaf spring system, whereby the leaf spring exerts a force against the body in a longitudinal direction relative to the first fixed edge of the frame aperture.

2. A leaf spring system according to claim 1, wherein a supporting element for detachably supporting the at least one leaf spring is disposed in the frame aperture between the first end of the at least one leaf spring and the first edge of the frame aperture.

3. A leaf spring system according to claim 2, wherein the supporting element is designed as a further body to be influenced by the spring action.

4. A leaf spring system according to claim 3, wherein said one and further body comprises a similar arm, the distance between the two bodies in the frame aperture being smaller than the length of the at least one leaf spring when the latter is situated essentially in the plane of the supporting frame.

5. A leaf spring system according to claim 4, wherein the arms project in the same direction from the frame aperture.

6. A leaf spring system according to claim 4, wherein the arms project in opposite directions from the frame aperture.

7. A leaf spring system according to claim 1, wherein the at least one body comprises an arm which projects from the frame aperture and being capable of making a rotary movement about the second edge of the frame aperture, said arm being capable of producing a bending of the at least one leaf spring so that when the arm is moved in a direction against the spring action past a transition point, the spring action thereon reverses direction and the at least one leaf spring exerts a force on the arm in a reverse direction of movement.

8. A leaf spring system according to claim 7, wherein the part of the arm clamped between the second end of the at least one leaf spring and the second edge of the frame aperture is provided on either side with notches in which the second end of the at least one leaf spring and the second edge of the frame aperture respectively engage, while the influence on the arm by the at least one leaf spring is determined by the distance between and the position of the notches.

9. A leaf spring system according to claim 1, wherein the leaf spring system comprises two leaf springs which extend in opposite directions from a common frame part for supporting the leaf springs, whereby the second ends of said respective leaf springs are able to act on an appropriate body.

10. A leaf spring system according to claim 1, wherein the at least one leaf spring is rectangular in shape.

11. A leaf spring system according to claim 1, wherein the at least one leaf spring is widened at least at the first end thereof.

12. A leaf spring system according to claim 11, wherein the at least one leaf spring is trapezoidal.

13. A leaf spring system according to claim 1, wherein the at least one leaf spring is made of several spring strips.

14. A leaf spring system according to claim 1, wherein the at least one leaf spring and the supporting frame are made by punching or stamping from a band of spring material.

15. A leaf spring system according to claim 1, wherein the at least one leaf spring and the supporting frame are made by spark erosion from a band of spring material.

16. A leaf spring system according to claim 1, wherein the at least one leaf spring and supporting frame are made by etching from a band of spring material.

17. An electric switch comprising a housing accommodating a leaf spring system, at least one pair of contacts and at least one body comprising at least one contact of said pair of contacts, and an immovable base member, said leaf spring system comprising at least one leaf spring having first and second opposite ends, and a supporting frame defining at least one frame aperture having first and second opposite fixed edges, the leaf spring being supported in the frame aperture by the first fixed edge at the first spring end thereof, said body being hingedly supported by the second fixed edge of the frame aperture and engaged by the second end of the leaf spring, said body having a dimension measured upon accommodation between the supporting opposite edge of the frame aperture and the engaging second end of the leaf spring which is greater than the distance from the second fixed edge of the frame aperture to the second end of the leaf spring when the body is not accommodated, the supporting frame being immovably fixed to the immovable base member and thereby secured against movement relative to the leaf spring and body, whereby the leaf spring exerts a force against the body in a longitudinal direction relative to the first fixed edge of the frame aperture.

* * * * *